US005248087A

United States Patent [19]

Dressler

[11] Patent Number: 5,248,087

[45] Date of Patent: Sep. 28, 1993

[54] LIQUID DROPLET GENERATOR

[76] Inventor: John L. Dressler, 1216 Waterwyck Trail, Spring Valley, Ohio 45370

[21] Appl. No.: 880,890

[22] Filed: May 8, 1992

[51] Int. Cl.[5] ..... B05B 1/08

[52] U.S. Cl. ..... 239/102.2; 239/4

[58] Field of Search ..... 239/102.1, 102.2

[56] References Cited

U.S. PATENT DOCUMENTS

| | | | |
|---|---|---|---|
| 3,868,698 | 2/1975 | Dressler . | |
| 4,138,687 | 2/1979 | Cha et al. . | |
| 4,257,799 | 3/1981 | Rosencwaig et al. . | |
| 4,528,070 | 7/1985 | Gamklin . | |
| 4,541,564 | 9/1985 | Berger et al. | 239/102.2 |
| 4,554,558 | 11/1985 | Beaudet et al. . | |
| 4,587,528 | 5/1986 | Beaudet . | |
| 4,635,849 | 1/1987 | Igashira et al. | 239/102.2 |
| 4,756,478 | 7/1988 | Endo et al. | 239/102.2 |
| 4,930,701 | 6/1990 | Porter et al. | 239/102.2 |

FOREIGN PATENT DOCUMENTS

| | | | |
|---|---|---|---|
| 143019 | 11/1978 | Japan | 239/102.1 |
| 1-274859 | 11/1989 | Japan | 239/102.1 |
| 1140838 | 2/1985 | U.S.S.R. | 239/102.1 |
| 556577 | 6/1986 | U.S.S.R. | 239/102.2 |

OTHER PUBLICATIONS

Crane et al., "The Effect of Mechanical Vibration on the Break-up of a Cylindrical Water Jet in Air", Brit. J. Appl. Phys., vol. 15, pp. 743-751, 1964.

McCormack et al., "An Experimental and Theoretical Analysis of Cylindrical Liquid Jets Subjected to Vibration", Brit. J. Appl. Phys, vol. 16, pp. 395-409, 1965.

Park et al., A Device for Producing Controlled Collisions Between Pairs of Drops, Chemical Engineering Science, vol. 28, pp. 39-45, 1965.

Mason et al, An Improved Vibrating Capillary Device for Producing Uniform Water Droplets of 15 to 500 μm Radius, J. Sci. Instrum, vol. 40, pp. 247-249, 1963.

Wallace et al., Study of Orifice Fabrication Technologies for the Liquid Droplet Radiator, NASA Contractor Report 187114, NASA Lewis Research Center, Inc., May 1991.

Maissel et al., Handbook of Thin Film Technology, pp. 7-1-7-5.

Adam et al., The Collision, Coalescence, and Disruption of Water Droplets, Journal of Applied Physics, vol. 39, No. 11, pp. 5173-5180, Oct. 1968.

Dressler, A Shock Model of Liquid Jet Breakup, 1976.

Dunne et al., Some Phenomena Associated with Supersonic Liquid Jets, Journal of Applied Physics, vol. 25, No. 5, pp. 569-572, May, 1954.

Dunne et al., Velocity Discontinuity Instability of a Liquid Jet, Journal of Applied Physics, vol. 27, No. 6, pp. 577-582, Jun. 1956.

Van Dyke, An Album of Liquid Motion, pp. 69, 86 and 87.

Ibrahim et al., Impinging Jets Atomization, Physics of Fluids A, vol. 3, No. 12, pp. 2981-2987, Dec., 1991.

*Primary Examiner*—Andres Kashnikow
*Assistant Examiner*—Kevin P. Weldon
*Attorney, Agent, or Firm*—King and Schickli

[57] ABSTRACT

A droplet generator is provided for atomizing a fluid jet into a stream of droplets. The droplet generator comprises a housing having a first end, a second end, and an inner cavity. The second end of the housing has at least one orifice therein. An acoustic transducer is connected to the housing and has a first portion located within the cavity and spaced a given distance from the second end of the housing. The first portion of the acoustic transducer and the second end of the housing define a manifold therebetween for receiving a fluid. A fluid supply is connected to the acoustic transducer for supplying fluid under pressure to the inner cavity and into the manifold. The fluid passes from the manifold via the orifice as a stream of fluid. A drive mechanism is provided for driving the transducer and causing the first portion of the transducer to impart acoustic energy to the fluid in the manifold, thereby creating velocity perturbations on the stream of fluid which are sufficient to atomize the fluid.

12 Claims, 6 Drawing Sheets

Fig. 9
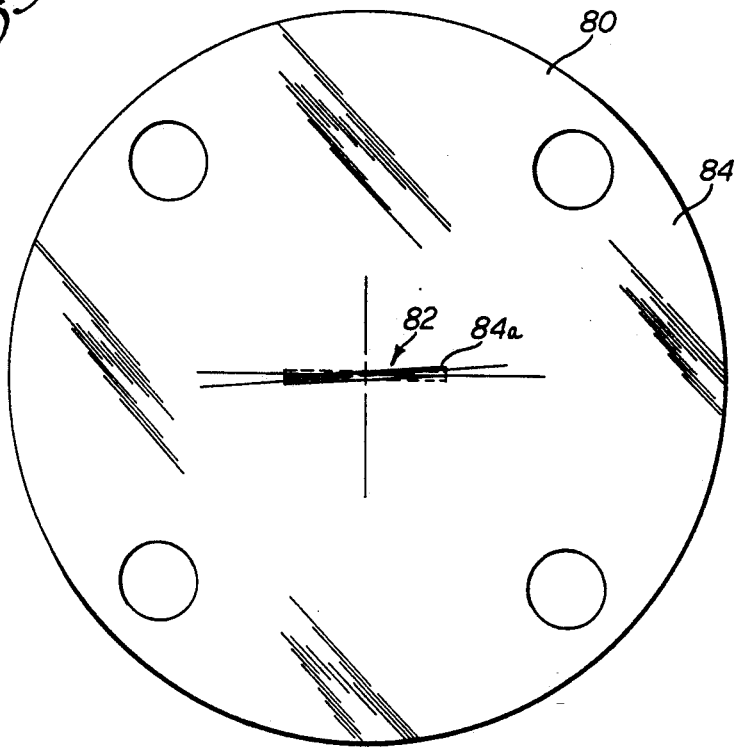
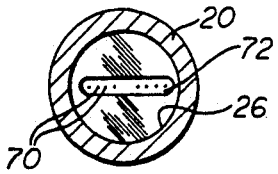
Fig. 6
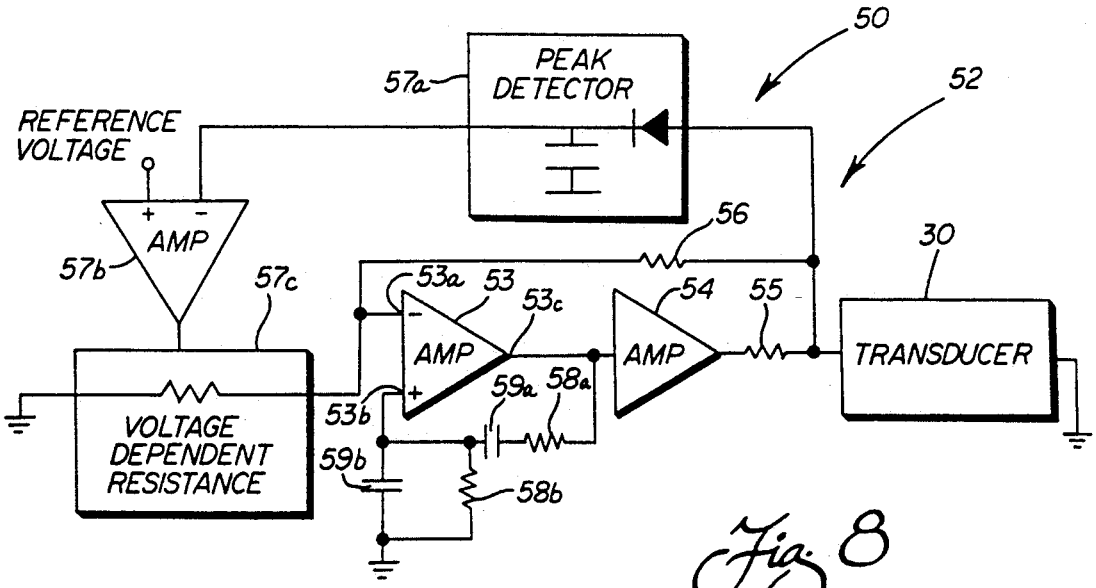
Fig. 8

LIQUID DROPLET GENERATOR

GOVERNMENT RIGHTS

The U.S. Government has a paid-up license in this invention and the right in limited circumstances to require the patent owner to license others on reasonable terms as provided for by the terms of contract No. (F33615-89-C-2973) awarded by the U.S. Air Force.

BACKGROUND OF THE INVENTION

The present invention relates to a liquid droplet generator and, more particularly, to a high energy, acoustic droplet generator capable of creating high amplitude velocity perturbations on a stream of fluid which are sufficient to atomize the fluid into a stream of droplets.

The atomization of a jet or sheet of liquid is a process which, in most cases, requires energy to be added to the liquid. The added energy is converted into an increase in surface energy in the liquid as the initial liquid mass is separated into droplets. As the surface energy of the liquid increases, the surface area of the liquid likewise increases. Energy may be supplied for purposes of atomization from either a decrease in kinetic energy of the liquid or from an external source.

One prior art process for atomizing a fluid involves impinging a fast moving air stream onto a slower moving fluid, such as a fuel to be burned in a combustor of a turbine engine. With this process, the kinetic energy of the injected air serves to tear the liquid into filaments and then into drops. Thus, a portion of the kinetic energy of the injected air is converted into an increase in surface energy in the atomized fluid.

The prior art air injection process, when used to atomize a fuel to be burned in a turbine engine, is only effective when the engine is operating, since a source of high velocity air is needed for atomization. Further, higher engine operating temperatures, which result in greater engine operating efficiency, are difficult to achieve since excess air is added into the engine for purposes of atomization. Additionally, atomization by use of injected air results in an inconsistent distribution of fuel spray in both time and space. As a result, the combustor is required to be longer than otherwise necessary to ensure that all the fuel is burned before the air/fuel mixture exits the combustor. The inconsistent distribution of fuel spray also results in a non-uniform combustion of the air/fuel mixture causing an increase in NOx pollutants being emitted from the engine.

A further prior art atomization process involves the acoustic excitation of a circular liquid jet at an unstable wavelength. Rayleigh explained in 1878 that a circular fluid jet is unstable for azimuthally symmetric perturbations whose axial wavelength is longer than the circumference of the jet. This prior art process is based upon Rayleigh's theoretical work. The process involves placing small amplitude acoustic perturbations on a circular jet, wherein the perturbations have a wavelength longer than the circumference of the jet. The applied perturbations grow, due to an input of energy from surface tension, and break the jet into a stream of drops at the excitation frequency. This process adds little or no energy to the fluid. Thus, the surface area and surface energy of the fluid is lower after break-up than before. Further, the size of the resulting drops produced by this process have a diameter approximately twice the diameter of the original jet. Thus, if small drops are desired, small nozzles or orifices must be used. Small nozzles, however, can be easily obstructed by particles carried by a fluid. Consequently, this process is disadvantageous for use where small droplets are desired. Further, this process will not induce atomization of a sheet of liquid.

Accordingly, there is a need for an apparatus which is capable of adding energy to a liquid stream for purposes of atomization without employing high velocity air. There is a further need for an apparatus capable of employing acoustic energy for atomizing a liquid stream into a stream of droplets having a greater surface area and surface energy than that of the initial stream, and which is further capable of inducing atomization of a sheet of liquid.

SUMMARY OF THE PRESENT INVENTION

This need is met by the method and apparatus of the present invention, wherein a high energy, acoustic droplet generator is provided for imparting energy into a stream of liquid in the form of velocity perturbations for purposes of atomizing the fluid into a stream of droplets. Because energy is added to the liquid stream, the surface area and the surface energy of the resulting stream of droplets is greater than that of the initial liquid stream.

In accordance with a first aspect of the present invention, a droplet generator is provided for breaking a fluid jet into a stream of droplets. The droplet generator comprises a housing having a first end, a second end, and an inner cavity. The second end of the housing has at least one orifice therein. An acoustic transducer is connected to the housing and has a first portion located within the cavity and spaced a given distance from the second end of the housing. The first portion of the acoustic transducer and the second end of the housing define a manifold therebetween for receiving a fluid. Fluid supply means are connected to either the housing or the acoustic transducer for supplying fluid under pressure to the inner cavity and into the manifold. The fluid passes from the manifold via the orifice as a stream of fluid. Drive means are provided for driving the transducer and causing the first portion of the transducer to impart acoustic energy to the fluid in the manifold, thereby creating velocity perturbations on the stream of fluid which are sufficient to atomize the fluid.

The acoustic transducer preferably comprises: a mount fixedly connected to the first end of the housing; a piston which defines the first portion of the transducer; piezoelectric means positioned between the mount and the piston for causing the piston to oscillate relative to the second end of the housing and impart acoustic energy to the fluid in the manifold; and, connector means for connecting the mount, the piston and the piezoelectric means to one another. Further provided is sealing means for sealing the piston to the housing and thereby forming a sealed chamber for receiving the fluid. At least a portion of the piston is positioned within the chamber and a section of the chamber is defined by the manifold. The piezoelectric means may comprise at least two piezoelectric crystals.

The mount includes a centrally located stepped bore. Each of the piezoelectric crystals includes a centrally located bore extending therethrough, while the piston includes a centrally located threaded bore which extends at least partially therethrough. The connector means may comprise a bolt which extends through the bores in the mount and the piezoelectric crystals and threadedly engages with the threaded bore in the piston for connecting the mount, the piezoelectric crystals, and the piston to one another.

The bolt preferably includes a centrally located passage extending therethrough. The piston includes at least one additional bore extending from an outer surface thereof to communicate with the centrally located passage extending through the bolt. The fluid supply means communicates with the passage in the bolt for supplying fluid through the passage and the at least one additional bore in the piston to the cavity and into the manifold.

The drive means serves to drive the transducer at a natural frequency of the transducer. This causes large amplitude oscillations of the first portion of the transducer, thereby resulting in the first portion of the transducer imparting acoustic energy to the fluid in the manifold which results in large amplitude velocity perturbations on the stream of fluid.

In a first embodiment of the present invention, the housing includes a hollow main portion having first and second ends. The first end of the main portion defines the first end of the housing. A nozzle plate is connected to the second end of the hollow main portion. The nozzle plate defines the second end of the housing and has the at least one orifice formed therein.

In a second embodiment of the present invention, the housing comprises a hollow main portion having first and second ends. The first end of the main portion defines the first end of the housing. An intermediate nozzle plate support is connected to the second end of the hollow main portion. A nozzle plate is connected to the nozzle plate support and has the one orifice formed therein. The nozzle plate and the intermediate plate define the second end of the housing.

In accordance with a second aspect of the present invention, a method is provided for generating droplets from a stream of liquid. The method comprises the steps of: providing a housing having a first end, a second end, and an inner cavity, the second end having at least one orifice; providing an acoustic transducer having a first portion located within the cavity and spaced a given distance from the second end of the housing, the first portion of the acoustic transducer and the second end of the housing defining a manifold therebetween for receiving a fluid; supplying fluid under pressure to the inner cavity and into the manifold, the fluid passing from the manifold via the orifice as a stream of fluid; and, driving the acoustic transducer and causing the first portion of the acoustic transducer to impart acoustic energy to the fluid in the manifold, thereby creating velocity perturbations on the stream of fluid which are sufficient to atomize the fluid.

Preferably, the step of providing an acoustic transducer comprises the steps of: fixedly connecting a mount to the first end of the housing; providing a piston to define the first portion of the transducer; positioning piezoelectric means between the mount and the piston for causing the piston to oscillate relative to the second end of the housing and impart acoustic energy to the fluid in the manifold; and, connecting the mount, the piston and the piezoelectric means to one another. The piezoelectric means may comprise at least two piezoelectric crystals.

Preferably, the mount, the piezoelectric crystals, and the piston include bores as discussed above with regard to the first aspect of the present invention. The step of connecting the mount, the piston and the piezoelectric means to one another is performed by passing a bolt through the bores in the mount and the piezoelectric crystals and threadedly engaging the bolt with the bore in the piston for connecting the piezoelectric crystals, the mount and the piston to one another.

The bolt includes a centrally located passage extending therethrough. The piston includes an additional bore extending from an outer surface of the piston to communicate with the centrally located passage extending through the bolt. The step of supplying fluid to the inner cavity and into the manifold is performed by passing fluid through the passage in the bolt and the additional bore in the piston to the cavity and into the manifold.

The step of driving the transducer is performed at a natural frequency thereof causing large amplitude oscillations of the first portion of the transducer, thereby resulting in the first portion imparting acoustic energy to the fluid in the manifold which results in large amplitude velocity perturbations on the stream of fluid.

Accordingly, it is an object of the present invention to provide a method and apparatus for imparting energy into a stream of liquid in the form of velocity and pressure perturbations perturbations for purposes of atomizing the liquid into a stream of droplets. It is a further object of the present invention to provide an acoustic droplet generator for imparting energy into a circular liquid stream for atomizing the liquid into a stream of droplets having a diameter much less than twice the diameter of the initial jet. It is an additional object of the present invention to provide an acoustic droplet generator for imparting energy into a sheet of liquid for atomizing the same. It is yet another object of the present invention to provide an acoustic drop generator for imparting energy into a liquid stream for atomizing the liquid into a stream of droplets having a surface area and surface energy greater than that of the initial stream. These and other objects and advantages of the present invention will be apparent from the following description, the accompanying drawings, and the appended claims.

BRIEF DESCRIPTION OF THE DRAWINGS

FIG. 6 is a cross-sectional view taken generally along section line 6—6 of FIG. 5;

FIG. 8 is a generalized diagram of a stimulation driving circuit in accordance with the present invention;

FIG. 9 is a plan view of a nozzle plate in accordance with a second embodiment of the present invention;

DETAILED DESCRIPTION OF THE INVENTION

Figure 1:
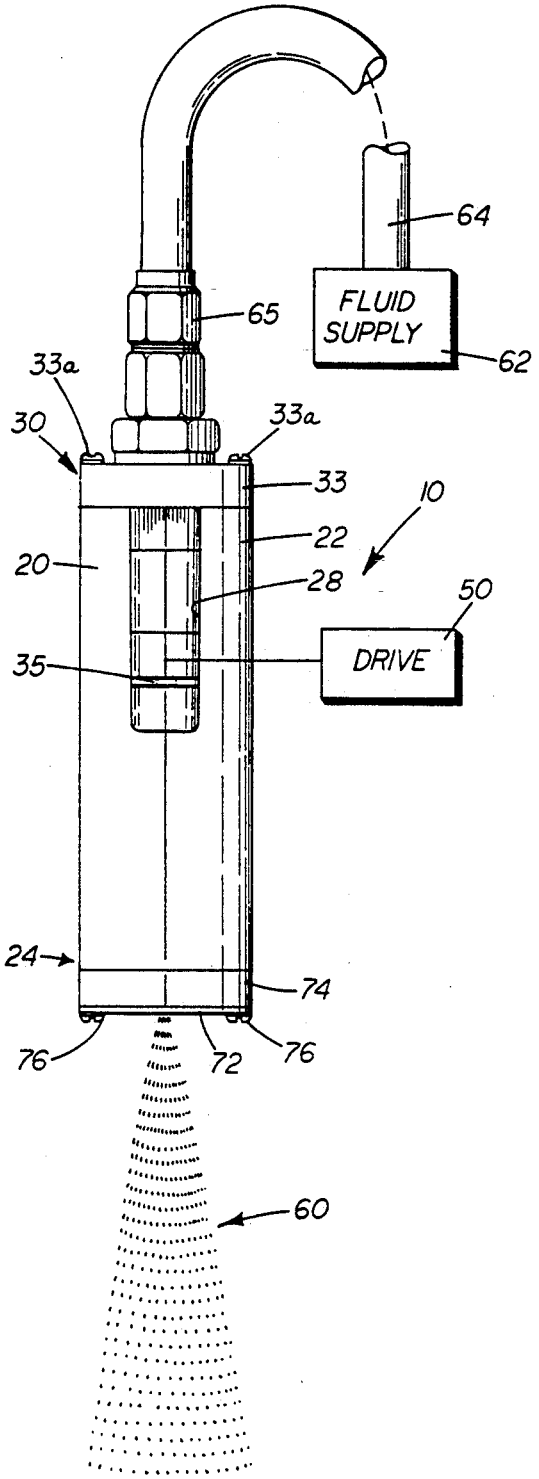
FIG. 1 is a side elevational view of the droplet generator of the present invention.
Figure 2:
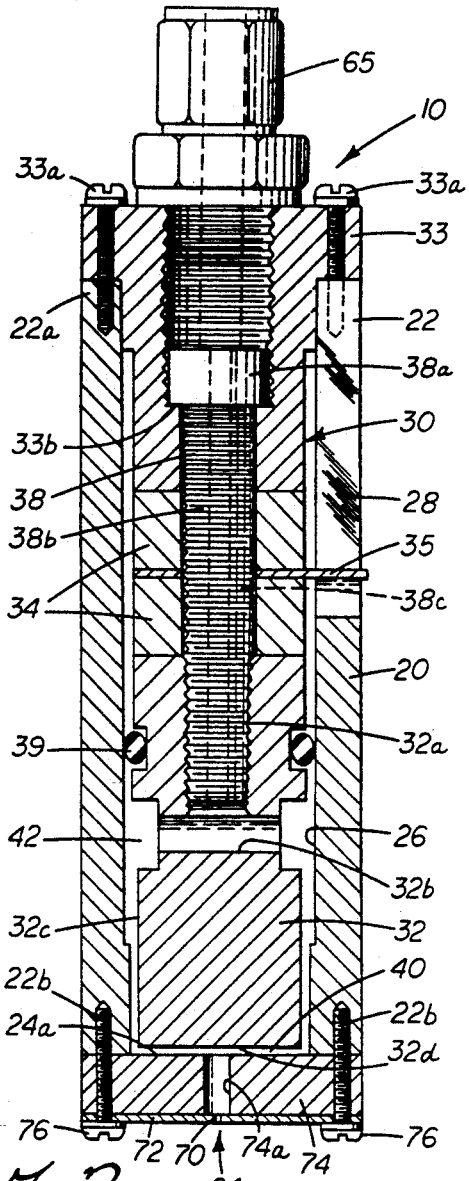
FIG. 2 is a partial-sectional view of the droplet generator shown in FIG. 1.

A droplet generator constructed in accordance with the present invention is shown in FIGS. 1 and 2, and is generally designated by the reference numeral 10. The droplet generator 10 includes a housing 20 having a substantially cylindrical main body portion 22 and an exit portion 24. Upper end 22*a* of the main body portion 22 defines a first end of the housing 20 and exit portion 24 defines a second end of the housing 20. Connected to the main body portion 22 of the housing 20 is an acoustic transducer 30. The transducer 30 includes a piston 32 (also referred to herein as a first portion of the transducer) located within an inner cavity 26 of the housing and spaced a given distance (e.g., between 0.010 in. and 0.025 in.) from an entrance surface 24*a* of the exit portion 24 of the housing 20. The piston 32 and the entrance surface 24*a* define a manifold 40 therebetween for receiving a fluid. Drive means 50 is connected to the transducer 30 for driving the transducer 30 and causing the piston 32 to impart acoustic energy to the fluid in the manifold 40, thereby creating high amplitude velocity perturbations on the outgoing stream of fluid which are sufficient to atomize the fluid into a stream of droplets 60, as shown in FIG. 1. Because energy is added to the stream of droplets 60, the surface area and the surface energy of the droplets 60 is greater than that of the initial liquid mass from which the droplets are formed.

Figure 7:
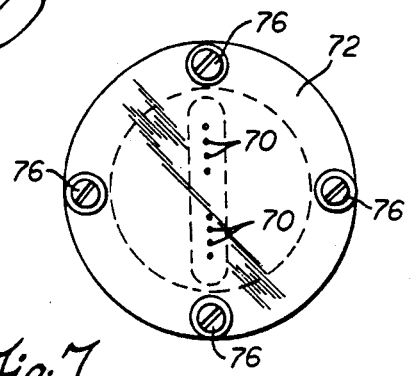
FIG. 7 is an end view of the droplet generator of FIG. 1 illustrating a nozzle plate in accordance with a first embodiment of the present invention.

A fluid supply 62 communicates with the acoustic transducer 30 through a fluid supply line 64 for providing pressurized fluid to the transducer 30. The fluid supplied to the transducer 30 passes from the transducer 30 into the inner cavity 26 and into the manifold 40. The fluid exits from the generator 10 via orifices or nozzles 70 formed within a nozzle plate 72, which comprises a first section of the exit portion 24 of the housing 20. In accordance with a first embodiment of the present invention, the orifices 70 are formed in the plate 72 as a linear array of spaced apart circular openings (see FIG. 7).

Figures 3, 4, 5:
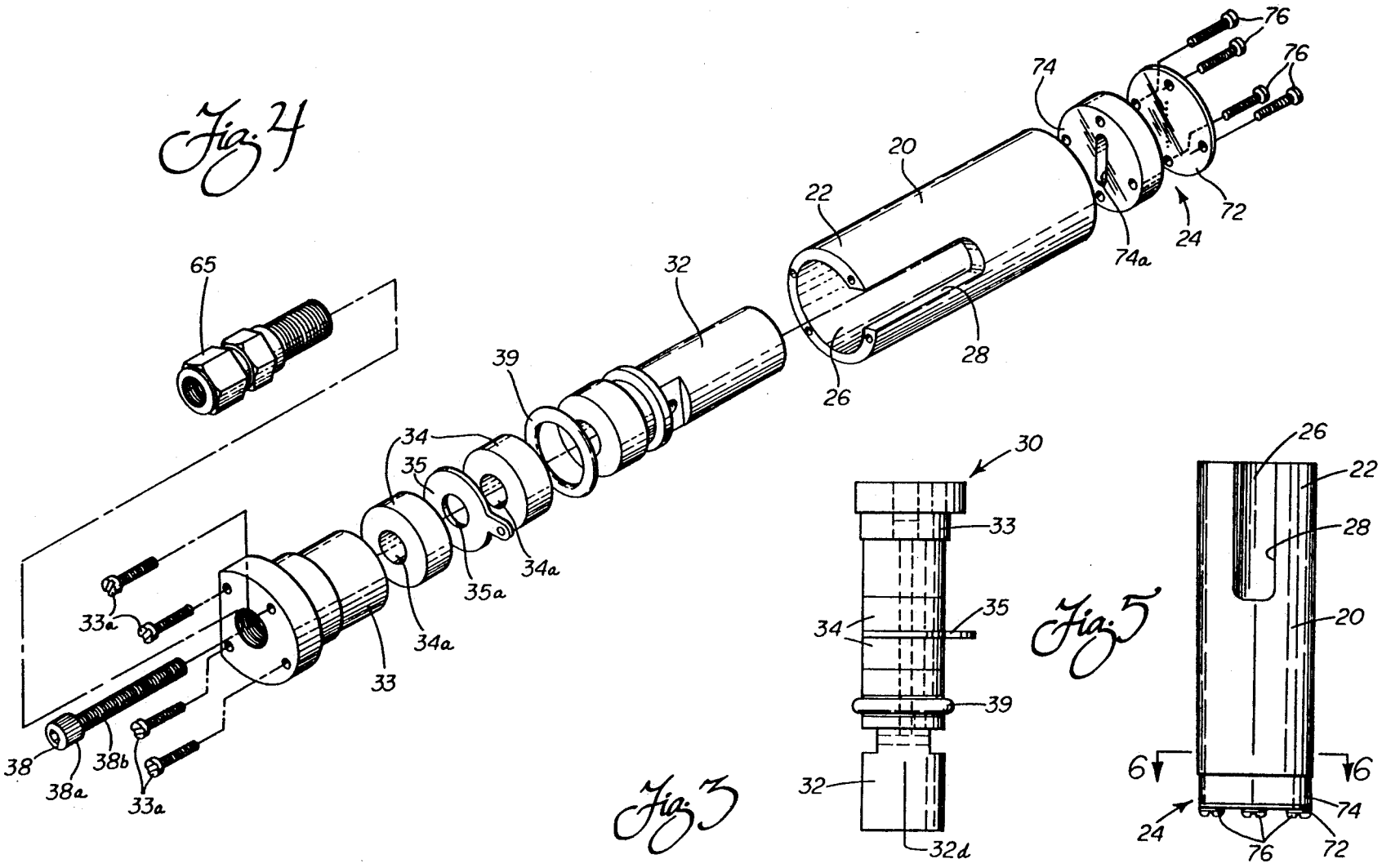
FIG. 3 is a side elevational view of the transducer of the droplet generator shown in FIG. 1.
FIG. 4 is an exploded perspective view of the droplet generator of the present invention.
FIG. 5 is a side elevational view of the housing of the droplet generator shown in FIG. 1.

Referring to FIGS. 2, 3 and 4, the acoustic transducer 30 includes a mount 33 fixedly connected to the main body portion 22 of the housing 20 via bolts 33*a*. Positioned between the mount 33 and the piston 32 are two piezoelectric crystals 34 having an electrode 35 interposed therebetween. The electrode 35 extends through a slot 28 in the main body portion 22 for connecting with the drive means 50, as illustrated in FIG. 1. As will be discussed in further detail below, the drive means serves to drive the transducer 30 for causing the piston 32 to oscillate relative to the exit portion 24 of the housing 20 and impart acoustic energy to the fluid in the manifold 40 to atomize the fluid.

A bolt 38 (also referred to herein as connector means) is provided for connecting the piston 32, the mount 33, the piezoelectric crystals 34, and the electrode 35 to one another to form the transducer 30. The bolt 38 passes through a centrally located stepped bore 33*b* in the mount 33, a centrally located bore 34*a* in each of the piezoelectric crystals 34 and a bore 35*a* located in the electrode 35. The upper portion 38*a* of the bolt 38 seats in the stepped bore 33*b* in the mount 33, while the lower portion 38*b* threadedly engages with a centrally located threaded bore 32*a* in the piston 32.

The transducer 30 further includes sealing means comprising an O-ring 39 for sealing the piston 32 to the main body portion 22 of the housing 20 and thereby forming a sealed chamber 42 for receiving the fluid. At least a portion of the piston 32 is positioned within the chamber 42 and a section of the chamber 42 is defined by the manifold 40.

The bolt 38 includes a centrally located passage 38*c* extending therethrough, as shown in dotted line in FIG. 2. The piston 32 includes an additional bore 32*b* extending from an outer surface 32*c* of the piston 32 for communicating with the centrally located passage 38*c* extending through the bolt 38. The fluid supply line 64 is connected to the mount 33 via connector 65 and communicates with the passage 38*c* in the bolt 38 for supplying fluid through the passage 38*c* and the additional bore 32*b* in the piston 32 to the sealed chamber 42 and into the manifold 40. The fluid supply means 62 preferably supplies fluid through line 64 at a pressure between 10–60 psi.

In accordance with the preferred embodiment of the present invention, a nozzle support plate 74 is interposed between the nozzle plate 72 and the main body portion 22 of the housing 20. The support plate 74 comprises a second section of the exit portion 24 of the housing 20 and its upper surface defines the entrance surface 24*a* of the exit portion 24 of the housing 20. The nozzle support plate 74 includes a centrally located opening 74*a* through which the fluid passes before it exits through the orifices 70 in the nozzle plate 72. Bolts 76 pass through corresponding openings in the plates 72 and 74 and threadedly engage with corresponding openings 22*b* found in the main body portion 22 of the housing 20 to secure the plates 72 and 74 to the main body portion 22. Adhesive (not shown), such as an epoxy, may be interposed between the nozzle support plate 74 and the nozzle plate 72 for further securing and sealing the nozzle plate 72 to the nozzle support plate 74. The nozzle support plate 74 acts to increase the rigidity of the nozzle plate 72. A more rigid nozzle plate 72 allows for a more efficient conversion of the oscillatory effects of the piston 32 to fully periodically compress the fluid thereby forming pressure perturbations in the fluid within the manifold 40. While not shown in the drawings, the nozzle plate 72 may alternatively be attached directly to the main body portion 22 of the housing 20 via bolts 76.

The drive means 50 preferably comprises the driving circuit 52 shown in FIG. 8, and disclosed in U.S. Pat. No. 3,868,698 (entitled "Stimulation Control Apparatus for an Ink Jet Recorder," issued Feb. 25, 1975), the disclosure of which is incorporated herein by reference. Briefly, the driving circuit includes a differential amplifier 53, a power amplifier 54, a load resistor 55, and negative and positive feedback loops to the negative and positive input terminals 53*a* and 53*b* of the differential amplifier 53. The negative feedback loop extends from output terminal 53*c* of differential amplifier 53 back around to the negative input terminal 53*a*. The negative feedback loop therefore includes load resistor 55 and branches out into two branches at the output side thereof. One of these two negative branches includes only a resistor 56, whereas the other branch comprises a peak detector 57*a*, a differential amplifier 57*b* and a voltage dependent resistance 57*c*. The positive feedback loop extends from output terminal 53*c* back through an R-C network to the positive input terminal 53*b*. The positive feedback loop comprises resistors 58*a* and 58*b* and capacitors 59*a* and 59*b* connected in a wien bridge arrangement. The circuit 52 serves to drive the transducer 30 at a natural frequency thereof and to track that frequency as it changes normally due to heating or other causes during operation of the droplet generator 10.

The transducer 30 normally has more than one natural frequency. Consequently, it is usually possible to drive the piezoelectric crystals 34 at more than one frequency. Additionally, several frequencies may be placed on the crystals 34 at the same time.

Because the transducer 30 is driven at a natural frequency thereof, the amplitude of motion of the bottom surface 32*d* of the piston 32 is much greater than the amplitude of motion of the crystals 34 combined. Consequently, the oscillating bottom surface 32*d* of the piston 32 imparts sufficient acoustic energy to the fluid in the manifold 40 to create large amplitude velocity perturbations on the fluid which result in atomization of the fluid into a stream of droplets.

Referring now to FIGS. 9, 10, 11A and 11B, a nozzle plate 80, constructed in accordance with a second embodiment of the present invention, is shown. The nozzle plate 80 is formed having a nozzle 82 through which fluid in the manifold 40 exits from the droplet generator 10. The plate 80 may be formed according to the process disclosed in U.S. Pat. No. 4,528,070, the disclosure of which is incorporated herein by reference. The plate 80 comprises first and second layers of nickel 84 and 86, respectively, and an intermediate layer of beryllium-copper 88 interposed therebetween, see FIGS. 11A and 11B.

Figure 10:
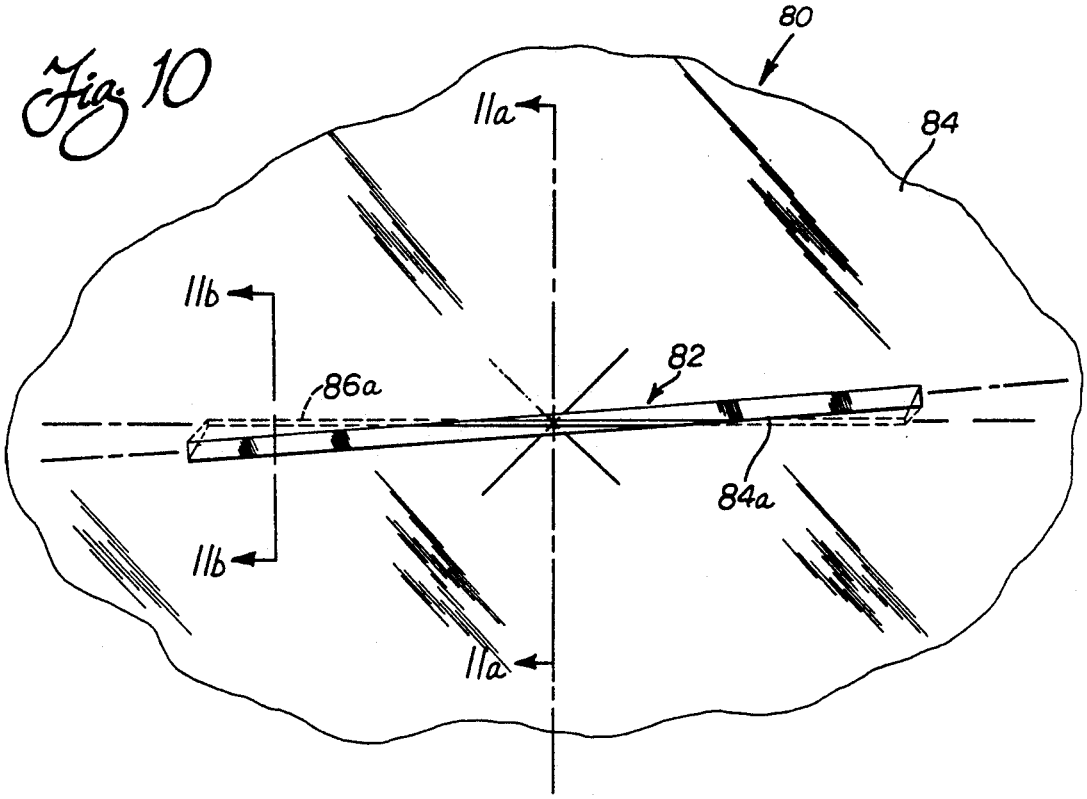
FIG. 10 is an enlarged plan view of the slot of the nozzle plate shown in FIG. 9.
Figure 11A:
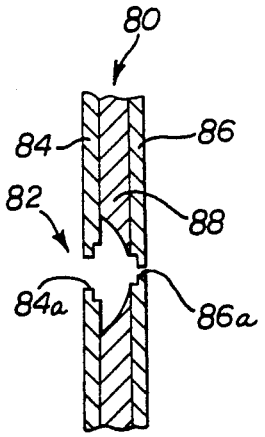
FIG. 11A is a cross-sectional view taken generally along section line 11A—11A in FIG. 10.
Figure 11B:
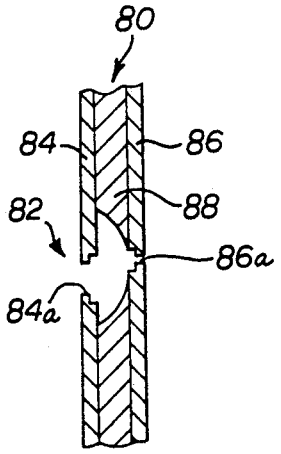
FIG. 11B is a cross-sectional view taken generally along section line 11B—11B in FIG. 10.

As shown in FIGS. 10, 11A and 11B, the first layer 84 is formed with an entrance slot 84*a* through which the fluid first passes as it exits from the manifold 40. The second layer 86 is formed with an exit slot 86*a* through which the fluid exits from the generator 10 after passing through the entrance slot 84*a*. As shown in FIG. 10, the entrance slot 84*a* is rotated from the exit slot 86*a* at an angle 8, which is approximately 4°. The entrance slot 84*a* has a length of approximately 0.220 in. and a width of approximately 0.006 in., while the exit slot 86*a* has a length of approximately 0.210 in. and a width of approximately 0.0015 in. The thickness of the plate 80 including the first, second and intermediate layers 84, 86 and 88, respectively, is approximately 0.010 in.

Figure 12:
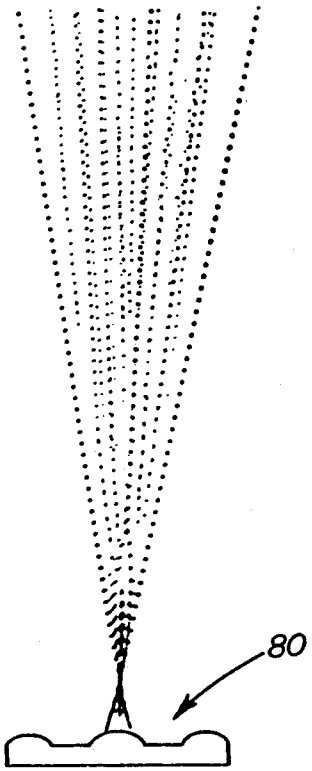
FIG. 12 is a photograph of a stream of droplets formed by the droplet generator of the present invention while employing the nozzle plate shown in FIG. 9.

A stream of droplets formed by a droplet generator 10 according to the present invention employing the nozzle plate 80 is shown in the photograph of FIG. 12. The droplet generator 10 included a nozzle support plate 74 having a thickness of approximately 0.25 in. The fluid supplied to the generator 10 comprised a formulation of water to glycerol in a weight ratio of 4:6. The fluid was supplied to the generator 10 at a pressure of approximately 33.6 psi. The drop generator transducer 30 was driven at a frequency of approximately 9.78 kHz, which was approximately equal to a natural frequency of the transducer 30. As shown in the photograph, the fluid, as it exits from the generator 10, first breaks into a plurality of horizontal filaments and then into a plurality of droplets.

Figure 14:
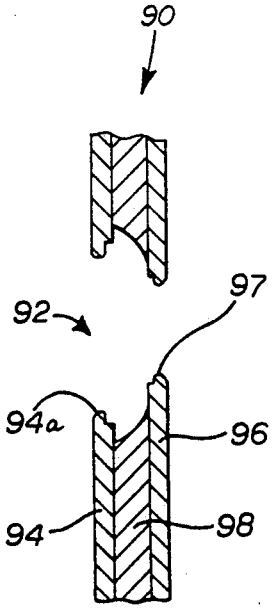
FIG. 14 is a cross-sectional view taken generally along section line 14—14 in FIG. 13.
Figure 13:
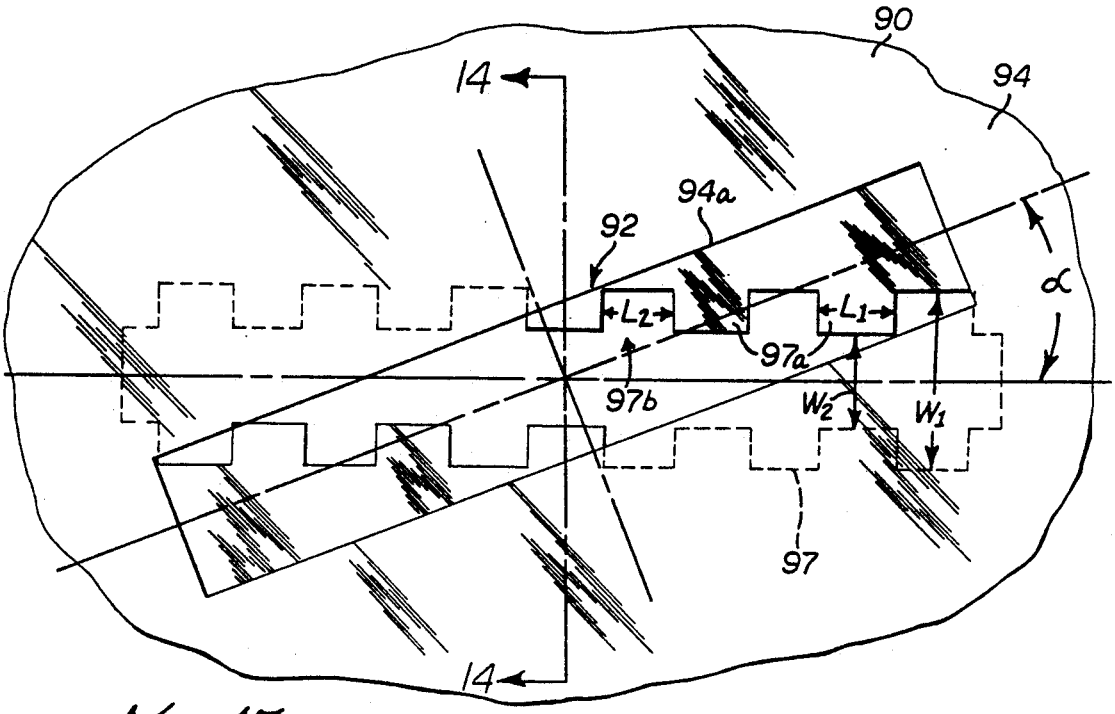
FIG. 13 is an enlarged plan view of the slot of a nozzle plate formed in accordance with a third embodiment of the present invention.

Referring now to FIGS. 13 and 14, a portion of a nozzle plate 90, constructed in accordance with a third embodiment of the present invention, is shown. The nozzle plate 90 includes a nozzle 92 through which fluid in the manifold 40 exits from the droplet generator 10. The nozzle plate 90 may be formed according to the process disclosed in U.S. Pat. No. 4,528,070. The nozzle plate 90 includes first and second layers of nickel 94 and 96, respectively, and an intermediate layer of beryllium-copper 98 interposed therebetween, see FIG. 14.

As shown in FIGS. 13 and 14, the first layer 94 is formed with an entrance slot 94*a* through which the fluid first passes as it exits from the manifold 40. The second layer 96 is formed with an exit slot 97 through which the fluid exits from the generator 10 after passing through the entrance slot 94*a*. The entrance slot 94*a* is rotated from the exit slot 97 at an angle $\alpha$ (shown exaggerated in FIG. 13), which is approximately 3.4°. The entrance slot 94*a* has a length of approximately 0.210 in. and a width of approximately 0.006 in. The exit slot 97 is formed with a plurality of per 97*a*, each having a length $L_1$ equal to approximately 0.026 in. The perturbations 97*a* are spaced from one another by openings 97*b*, each having a length $L_2$ equal to approximately 0.014 in. The exit slot 97 has a length of approximately 0.240 in. and has a first width $W_1$ equal to 0.003 in. and a second width $W_2$ equal to 0.0015 in. The thickness of the plate 90 including the first, second and intermediate layers 94, 96 and 98, respectively, is approximately 0.010 in.

Figure 15:
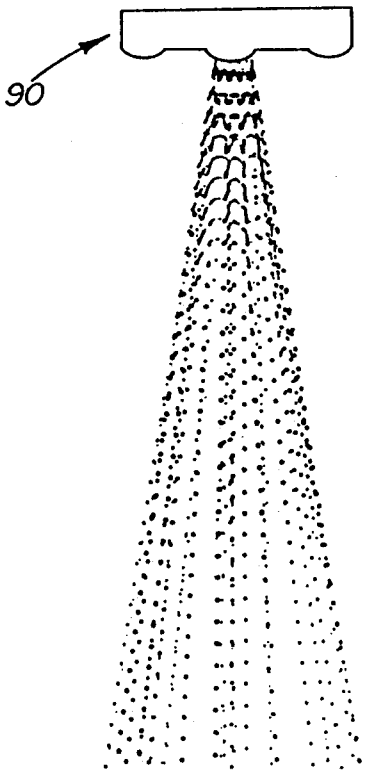
FIG. 15 is a photograph of a stream of droplets formed by the droplet generator of the present invention while employing a nozzle plate having the slot shown in FIG. 13.

A stream of droplets formed by a droplet generator 10 according to the present invention employing the nozzle plate 90 is shown in the photograph of FIG. 15. The droplet generator 10 included a nozzle support plate 74 having a thickness of approximately 0.25 in. The fluid supplied to the generator 10 comprised a formulation of water to glycerol in a weight ratio of 4:6. The fluid was supplied to the generator 10 at a pressure of approximately 33.6 psi. The drop generator transducer 30 was driven at a frequency of approximately 5.55 kHz, which was approximately equal to a natural frequency of the transducer 30. As shown in the photograph, as the fluid sheet exits from the generator 10, it breaks into horizontal filaments and then into a plurality of droplets.

Figure 16:
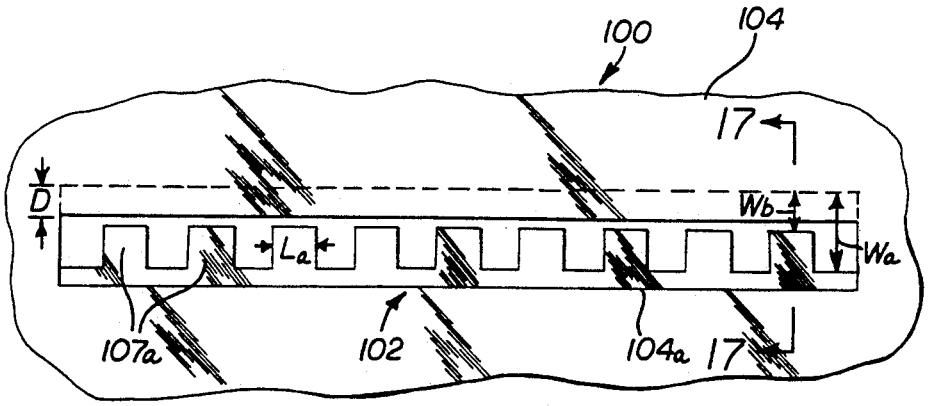
FIG. 16 is an enlarged plan view of the slot of a invention.
Figure 17:
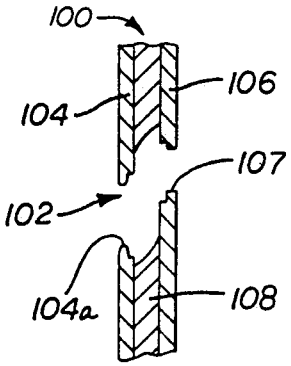
FIG. 17 is a cross-sectional view taken generally along section line 17—17 in FIG. 16; and, FIG. 18 is a photograph of a stream of droplets formed by the droplet generator of the present invention while employing a nozzle plate having the slot shown in FIG. 16.

Referring now to FIGS. 16 and 17, a portion of a nozzle plate 100, constructed in accordance with a fourth embodiment of the present invention, is shown. The nozzle plate 100 includes a nozzle 102 through which fluid in the manifold 40 exits from the droplet generator 10. The plate 100 may be formed according to the process disclosed in U.S. Pat. No. 4,528,070. The plate 100 includes first and second layers of nickel 104 and 106, respectively, and an intermediate layer of beryllium-copper 108 interposed therebetween, see FIG. 17.

As shown in FIGS. 16 and 17, the first layer 104 is formed with an entrance slot 104*a* through which the fluid first passes as it exits from the manifold 40. The second layer 106 is formed with an exit slot 107 through which the fluid exits from the generator 10 after passing through the entrance slot 104*a*. The entrance slot 104*a* has a length of approximately 0.210 in. and a width of approximately 0.0015 in. The exit slot 107 includes a plurality of perturbations 107*a*, each having a length $L_a$ equal to 0.010 in. The exit slot 107 has a length of approximately 0.210 second width $W_b$ approximately equal to 0.0015 in. The entrance slot 104*a* is offset from the exit slot 107 by a distance D which is approximately equal to 0.001 in. The thickness of the plate 100 including the first, second and intermediate layers 104, 106 and 108, respectively, is approximately 0.010 in.

Figure 18:
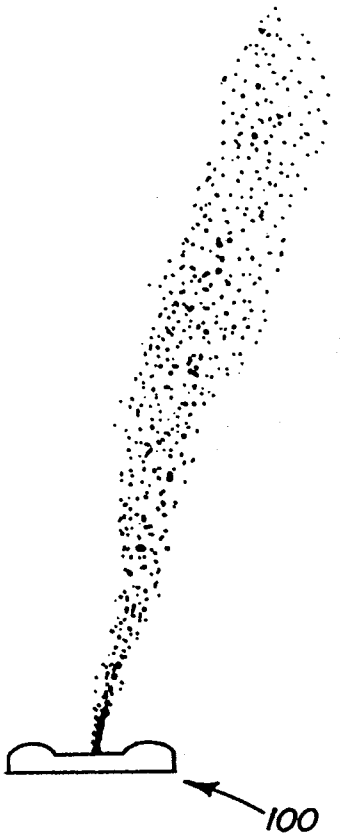

A stream of droplets formed by a droplet generator 10 according to the present invention employing the nozzle plate 100 is shown in the photograph of FIG. 18. The droplet generator 10 included a nozzle support plate 74 having a thickness of approximately 0.25 in. The fluid supplied to the generator 10 comprised a formulation of water to glycerol in a weight ratio of 4:6. The fluid was supplied to the generator 10 at a pressure of approximately 33.6 psi. The drop generator transducer 30 was driven at a frequency of approximately 9.64 kHz, which is approximately equal to a natural frequency of the transducer 30. As shown in the photograph, the fluid breaks into a plurality of droplets as it exits from the nozzle 102 at an angle from vertical.

By the present invention a method and apparatus are provided for imparting energy into a stream of liquid in the form of velocity perturbations for purposes of atomizing the liquid into a stream of droplets. Because energy is imparted into the stream of liquid, the liquid atomizes into a stream of droplets having a surface area and surface energy greater than that of the initial stream.

It is believed that the droplet generator 10 of the present application may be employed in applications such as agricultural spraying, spray drying and fuel injection.

Having described the invention in detail and by reference to preferred embodiments thereof, it will be apparent that modifications and variations are possible without departing from the scope of the invention defined in the appended claims. For example, it is contemplated that the transducer 30 may be driven with a high voltage so as to create large amplitude oscillations of the piston 32. It is additionally contemplated that several piezoelectric crystal pairs can be employed, and each pair may be driven at a different frequency.

What is claimed is:

1. A droplet generator comprising:

a housing having a first end, a second end, and an inner cavity, said second end having at least one dispensing orifice;

an acoustic transducer having a first portion located within said cavity and spaced a given distance from said second end of said housing, said first portion of said acoustic transducer and said second end of said housing defining a manifold therebetween for receiving a fluid;

a mount for said transducer fixedly connected to said first end of said housing;

a piston substantially sealed within said cavity to substantially isolate said manifold and defining said first portion of said transducer;

fluid supply means connected to one of said housing and said acoustic transducer for supplying fluid under pressure into said manifold, said fluid passing from said manifold via said orifice as a stream of fluid;

said transducer including piezoelectric means positioned between said housing and said piston for causing said piston to oscillate relative to said second end of said housing and impart acoustic energy to said fluid in said manifold, thereby creating velocity perturbations on said stream of fluid which are sufficient to atomize said fluid; and connector means for fixedly securing said mount, said housing, said piston and said piezoelectric means to one another, whereby said fluid is fully periodically compressed in said manifold by said piston against the fixed second end of said housing forming pressure perturbations to enhance the atomization of said fluid.

2. A droplet generator as set forth in claim 1, wherein said piezoelectric means comprises at least two piezoelectric crystals.

3. A droplet generator as set forth in claim 2, wherein said mount includes a centrally located stepped bore;

each of said piezoelectric crystals includes a centrally located bore extending therethrough;

said piston includes a centrally located threaded bore which extends at least partially therethrough; and, said connector means comprises a bolt which extends through said bores in said mount and said piezoelectric crystals and threadedly engages with said threaded bore in said piston for connecting said mount, said piezoelectric crystals, and said piston to one another.

4. A droplet generator as set forth in claim 3, wherein said bolt includes a centrally located passage extending therethrough;

said piston includes at least one additional bore extending from an outer surface thereof to communicate with said centrally located passage extending through said bolt; and, said fluid supply means communicates with said passage in said bolt for supplying said fluid through said passage and said at least one additional bore in said piston into said manifold.

5. A droplet generator as set forth in claim 1, wherein said drive means drives said transducer at a natural frequency thereof causing large amplitude oscillations of said piston, thereby resulting in said piston imparting acoustic energy and periodically compressing said fluid in said manifold which results in large amplitude velocity and pressure perturbations on and in aid stream of fluid.

6. A droplet generator as set forth in claim 1, wherein said housing comprises:

a hollow main portion having first and second ends, said first end of said main portion defining said first end of said housing; and a nozzle plate fixedly connected to said second end of said hollow main portion, said plate defining said fixed second end of said housing and having said orifice formed therein.

7. A droplet generator as set forth in claim 1, wherein said housing comprises:

a hollow main portion having first and second ends, said first and second ends of said main portion defining said first and second ends of said housing, respectively;

an intermediate nozzle plate support rigidly connected to said second end of said hollow main portion; and, a nozzle plate securely connected to said nozzle plate support, said nozzle plate having said orifice formed therein, and said nozzle plate and said intermediate plate defining said fixed second end of said housing.

8. A method for generating droplets comprising:

providing a housing having a first end, a second end, and an inner cavity, said second end having at least one dispensing orifice;

fixing an acoustical transducer to said housing including to said first and second ends;

locating a first portion of said transducer within said cavity and defining a piston spaced a given distance from the fixed second end of said housing, said piston and said fixed second end of said housing defining a manifold therebetween for receiving a fluid;

supplying fluid under pressure into said manifold;

sealing said piston within said cavity to substantially isolate said manifold;

passing said fluid from said manifold via said orifice as a stream of fluid; and driving said acoustical transducer and causing said piston to impart acoustical energy to said fluid in said manifold, and so as to be periodically compressed forming pressure perturbations against said fixed second end thereby creating velocity and pressure perturbations on and in said stream of fluid which are sufficient to atomize said fluid.

9. A method for generating droplets as set forth in claim 8, wherein the step of driving said acoustical transducer is performed by activating a piezoelectric means.

10. A method for generating droplets as set forth in claim 9, wherein said step of supplying fluid into said manifold includes passing said fluid through said transducer and said piston, and then into said manifold.

11. A method for generating droplets as set forth in claim 8, wherein said step of driving said transducer is performed at a natural frequency thereof causing large amplitude oscillations of said first portion of said transducer, thereby resulting in said piston imparting acoustic energy to said fluid in said manifold which results in large amplitude velocity perturbations on said stream of fluid.

12. A droplet generator comprising:

a housing having a first end, a second end, and an inner cavity, said second end having at least one dispensing orifice;

a piston substantially sealed within said cavity;

an acoustical transducer connected to one of said housing and said piston;

said piston being spaced a given distance from said second end of said housing defining a manifold therebetween for receiving a fluid;

sealing means positioned between said piston and said housing within said cavity to substantially seal and isolate said manifold from said first end of said housing;

a mount fixedly connected to said first end of said housing;

fluid supply means connected to one of said housing and said piston for supplying fluid under pressure into said manifold, said fluid passing from said manifold via said orifice as a stream of fluid;

said transducer being positioned between said housing and said piston for causing said piston to oscillate relative to said second end of said housing and impart acoustical energy to said fluid in said manifold, thereby creating velocity perturbations on said stream of fluid which are sufficient to atomize said fluid; and connector means for fixedly securing said mount, said housing, said piston and said transducer to one another, whereby said fluid is fully periodically compressed in said manifold by said piston against the fixed second end of said housing forming pressure perturbations to enhance the atomization of said fluid.

* * * * *